US009890586B2

(12) United States Patent
Zhang et al.

(10) Patent No.: US 9,890,586 B2
(45) Date of Patent: Feb. 13, 2018

(54) SUNSHADE STRUCTURE

(71) Applicant: NIEN MADE ENTERPRISE CO., LTD., Taichung (TW)

(72) Inventors: De-Jun Zhang, Taichung (TW); Keng-Hao Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/932,733

(22) Filed: Nov. 4, 2015

(65) Prior Publication Data

US 2017/0122030 A1 May 4, 2017

(51) Int. Cl.
*E06B 9/58* (2006.01)
*E06B 9/42* (2006.01)

(52) U.S. Cl.
CPC ..... *E06B 9/582* (2013.01); *E06B 9/42* (2013.01)

(58) Field of Classification Search
CPC .... E06B 9/582; E06B 9/58; E06B 2009/6845; E06B 9/42
USPC ..... 160/273.1, 195
See application file for complete search history.

(56) References Cited

U.S. PATENT DOCUMENTS 4,357,978 A * 11/1982 Keller ..... E06B 9/17046 160/271
4,597,430 A * 7/1986 Marquez ..... E06B 9/17046 160/23.1
4,987,943 A * 1/1991 Charest ..... E06B 9/54 160/120
5,092,388 A * 3/1992 Evers ..... E06B 9/521 160/26
5,909,763 A * 6/1999 Link ..... E06B 9/58 160/269
6,152,208 A * 11/2000 Kalempa ..... E06B 7/2318 160/118
2009/0014134 A1* 1/2009 Hanley ..... E06B 9/42 160/266
2015/0096696 A1* 4/2015 Sentjurc ..... E06B 9/17076 160/309

* cited by examiner

*Primary Examiner* — Blair M Johnson
(74) *Attorney, Agent, or Firm* — Lynette Wylie; Apex Juris, pllc.

(57) ABSTRACT

A sunshade structure is disclosed, which is installed on a window frame, and includes a main shading member and an auxiliary shading member. The main shading member is a window covering having a headrail, a bottom rail, and a covering assembly which connects the headrail and the bottom rail. The auxiliary shading member includes at least one movable plate. When the bottom rail is located at a first position away from the headrail, the at least one movable plate approaches the covering assembly to cover a gap formed between the covering assembly and a lateral side of the window frame; when the bottom rail leaves the first position and moves toward a second position near the headrail, the at least one movable plate pivots to stop blocking out light from outside.

13 Claims, 19 Drawing Sheets

SUNSHADE STRUCTURE

BACKGROUND OF THE INVENTION

1. Technical Field

The present invention relates generally to an indoor device used for blocking out light from outside, and more particularly to a sunshade structure which has a shading member to prevent light form leaking in through the gaps formed between a window covering and a window frame.

2. Description of Related Art

Conventional sunshade structures used in windows of buildings are mostly window coverings. A common seen window covering typically includes a headrail, a covering assembly, and a bottom rail, wherein the headrail is installed above the upper side of a window frame, and the covering assembly is respectively connected to the headrail and the bottom rail with two opposite ends thereof. According to its structure, the covering assembly can be classified as a window blind with multiple slats, a roller shade or a Roman shade with a drapery, or other kinds of blinds. The bottom rail is controllable to move up and down between two positions which are near or away from the headrail to expand or retract the covering assembly.

Generally, a little gap is intentionally left between each lateral side of the covering assembly and the window frame to avoid improper contact between the bottom rail and the lateral wall of the window frame while moving the bottom rail up and down. In this way, the installation can be easier, and the covering assembly can be expanded or retracted more smoothly. In addition, there is another gap formed between the headrail and the upper edge of the window frame. However, light from outside may leak in through these gaps, and such problem must be quite bothersome for those require perfect light-blocking effect. Furthermore, the leaked-in light tends to form a strip of light, which may produce an uncomfortable strong light and shade contrast in the room. What's worse, a user would definitely be annoyed if the strip of light happens to cast on the display or monitor which he or she is currently using.

BRIEF SUMMARY OF THE INVENTION

In view of the above, the primary objective of the present invention is to provide a sunshade structure, which shades the gaps between the covering assembly and the window frame to provide excellent light-blocking effect.

The present invention provides a sunshade structure, which is installed on a window frame of a building, and includes a main shading member and an auxiliary shading member. The main shading member includes a headrail, a bottom rail, and a covering assembly connecting the headrail and the bottom rail, wherein the headrail is installed at a top portion of the window frame; the bottom rail is controllable to move between a first position, which is away from the headrail, and a second position, which is near the headrail. The auxiliary shading member is fixed on the window frame, and includes at least one movable plate. When the bottom rail is at the first position, the movable plate is driven to approach the covering assembly to cover a gap formed between the covering assembly and one of two lateral surfaces of the window frame; when the bottom rail is moved to leave the first position and toward the second position, the movable plate is driven to pivot.

Whereby, the gaps between the covering assembly and the window frame can be shaded by providing the at least one movable plate in the present invention.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
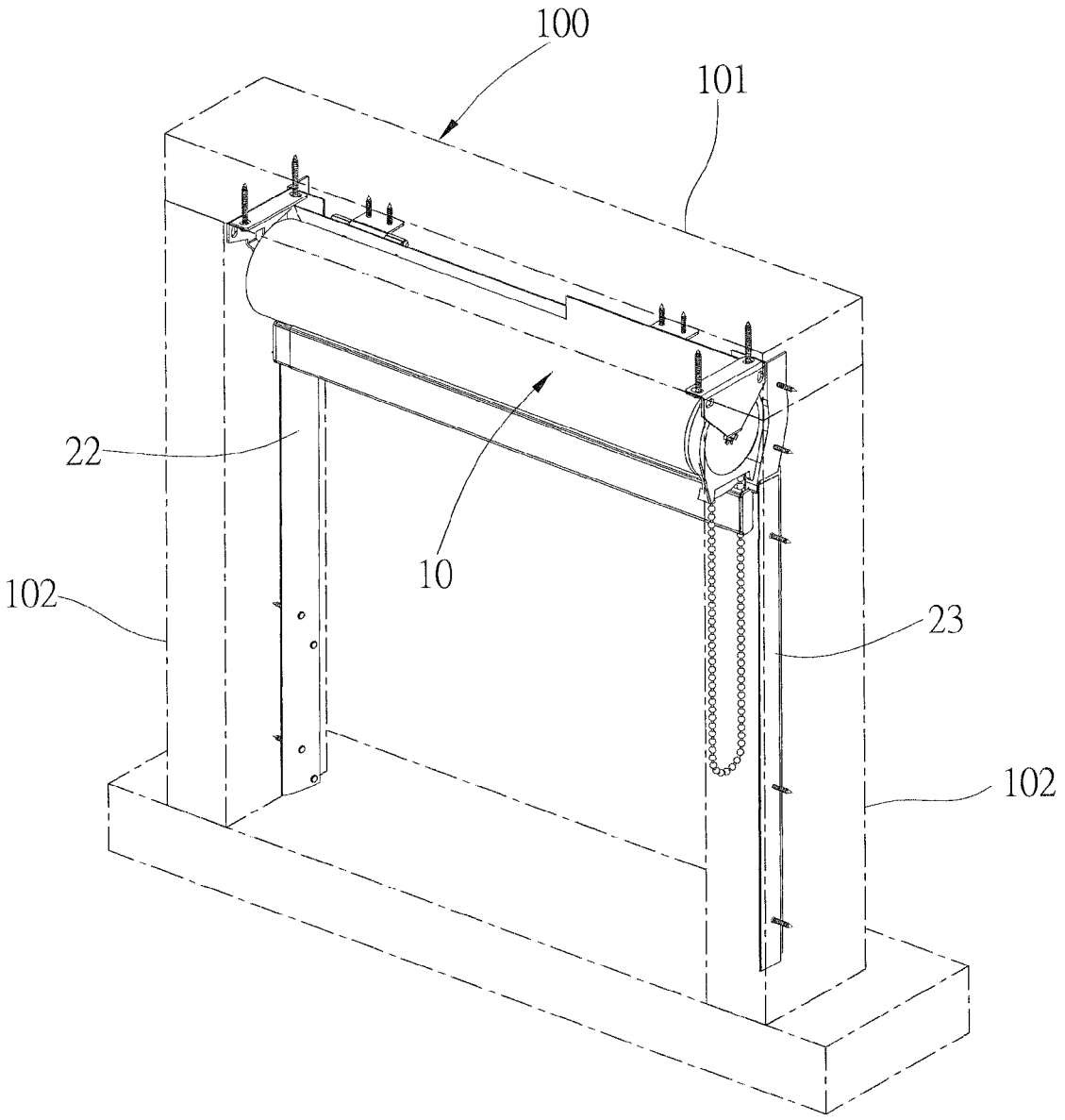
FIG. 1 and FIG. 2 are perspective views of a first preferred embodiment.
Figure 2:
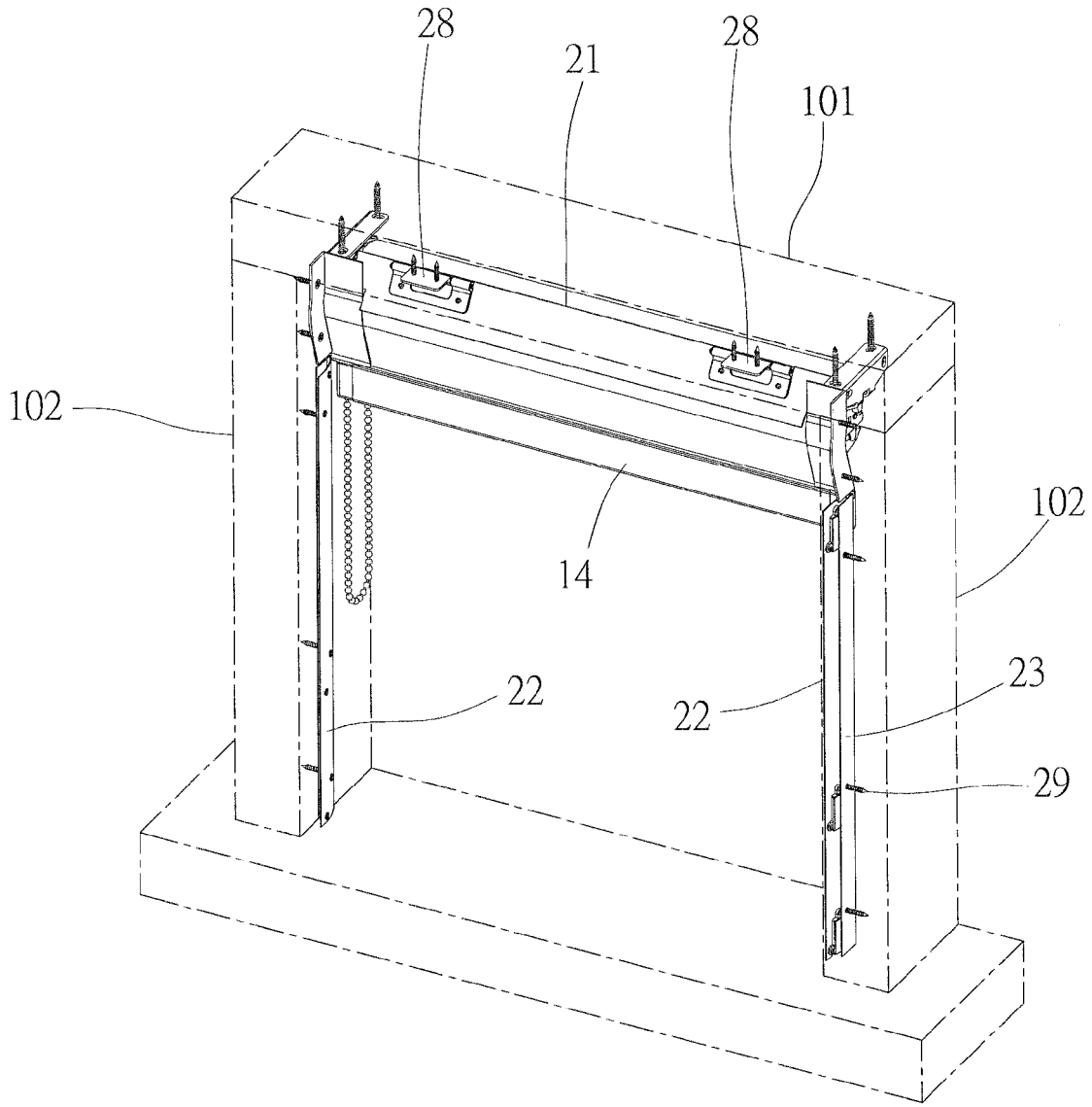
Figure 3:
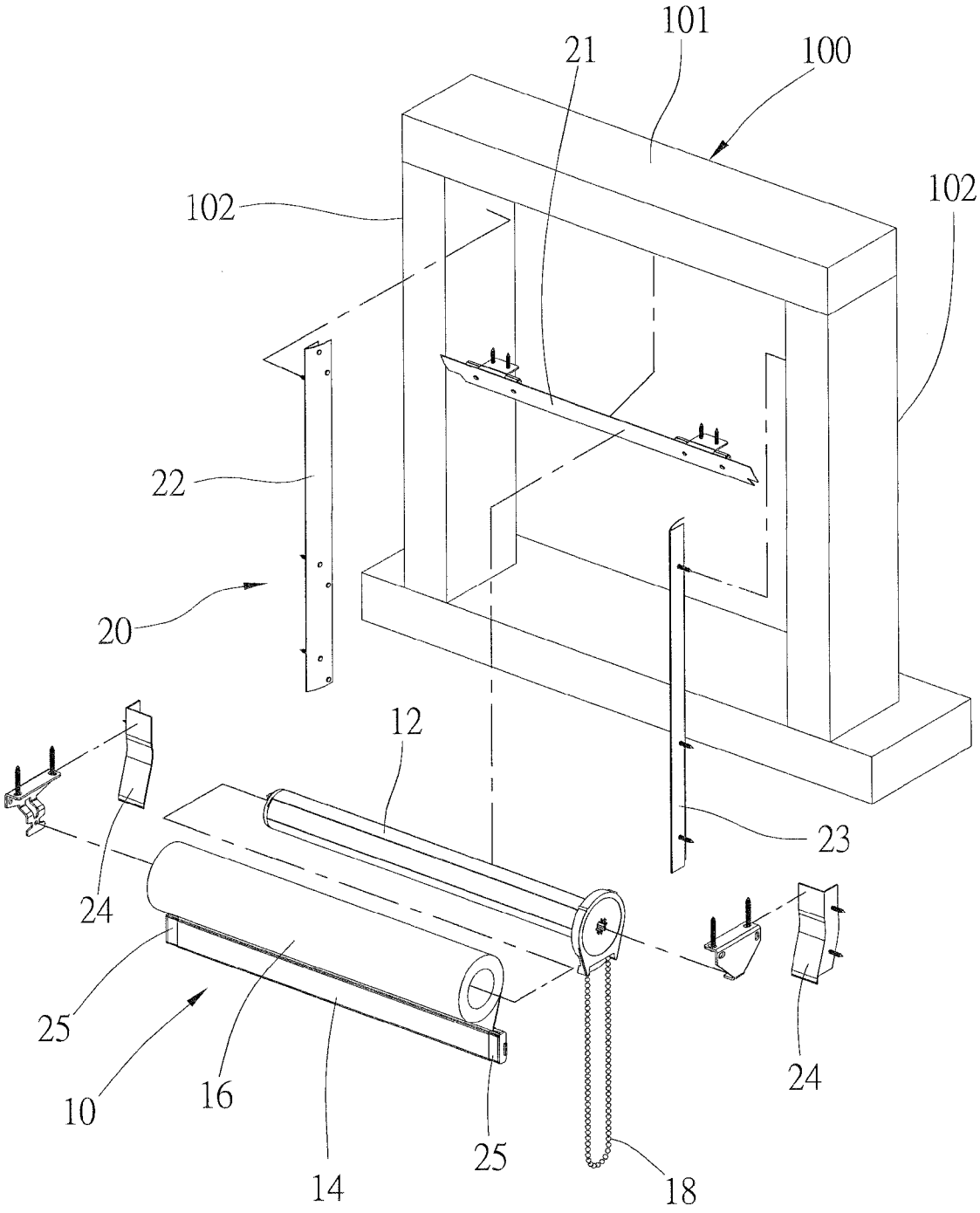
FIG. 3 is an exploded view of the first preferred embodiment.

As shown in FIG. 1 to FIG. 3, a sunshade structure of the first preferred embodiment of the present invention is installed on a window frame 100 of a building, wherein the window frame 100 includes an upper beam 101 and two columns 102, which are connected to two ends of the upper beam 101. The sunshade structure includes a main shading member 10 and an auxiliary shading member 20.

Figure 4:
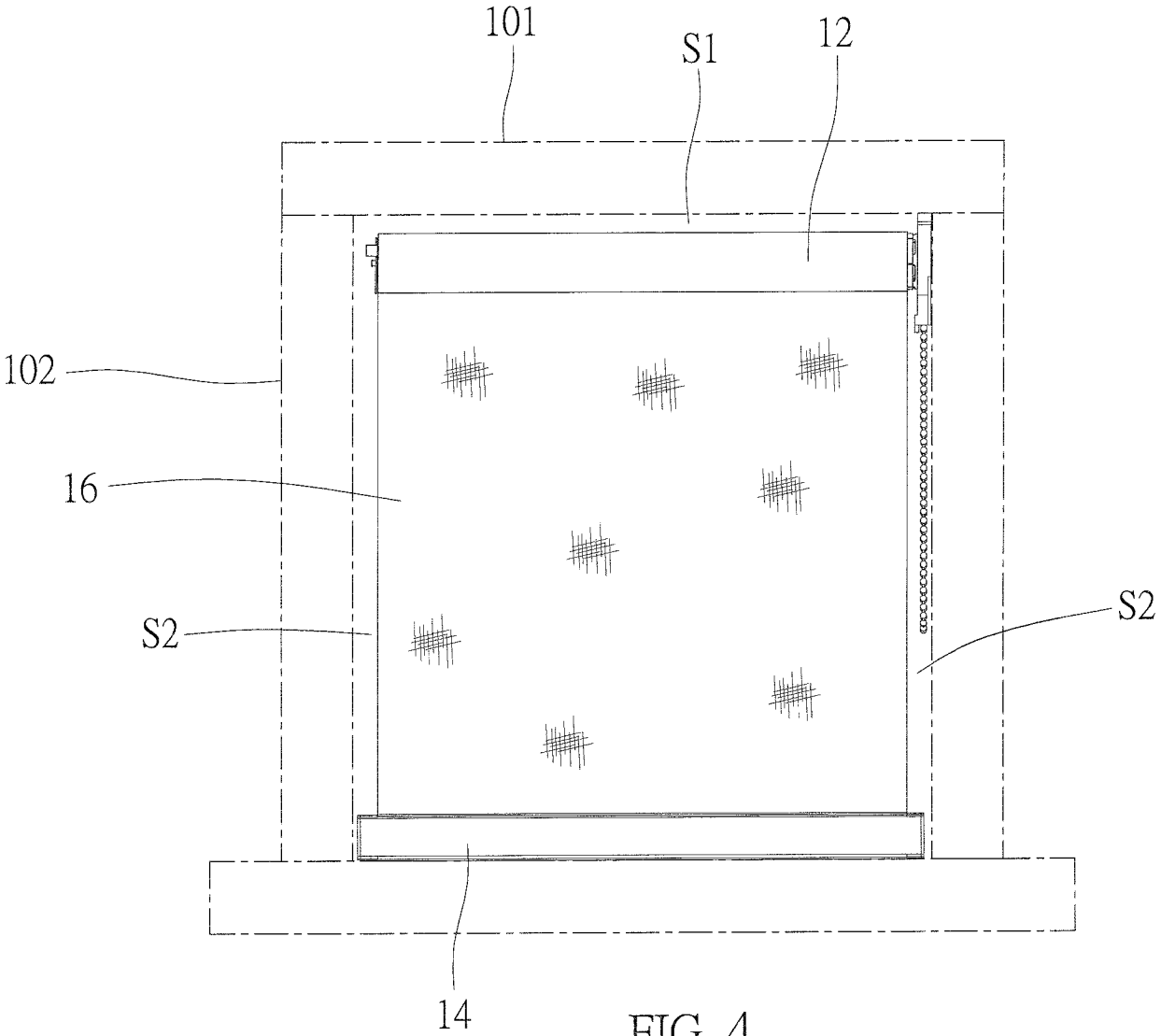
FIG. 4 is a front view of the first preferred embodiment, showing there are gaps between the window frame and the main shading member.

The main shading member 10 is a kind of window covering, which includes a headrail 12, a bottom rail 14, and a covering assembly 16 connecting the headrail 12 and the bottom rail 14. The headrail 12 is installed between the two columns 102 of the window frame 100, and is near the upper beam 101. The bottom rail 14 is controllable to move up and down relative to the headrail 12. In the first preferred embodiment, the headrail 12 is a rotatable roller, which can be rotated by a bead chain 18. The bottom rail 14 is mainly used to provide weight. The covering assembly 16 is a drapery. With such design, when the headrail 12 is rotated, the bottom rail 14 is indirectly driven to move. As shown in FIG. 4, just as the situation that a conventional window covering has, there is a gap S1 formed between the headrail 12 and the upper beam 101 after the main shading member 10 is installed. Furthermore, a gap S2 is also formed between each lateral side of the covering assembly 16 and the corresponding column 102. By definition, the gap formed between each lateral side of the bottom rail 14 and the corresponding column 102 is considered part of the gap S2 at the same side.

In order to solve the problem of leaking light through the aforementioned gap S1 and gaps S2, the auxiliary shading member 20 is installed behind the main shading member 10 in the first preferred embodiment. In other words, for someone who is in the room and looking outside, he or she sees the main shading member 10 first, and the auxiliary shading member 20 is hidden therebehind.

The auxiliary shading member 20 includes three movable plates, two fixing plates 23, two blocking plates 24, and a driving assembly, wherein the three movable plates include a first movable plate 21 and two second movable plates 22. In the first preferred embodiment, the first movable plate 21 is a light, thin, and elongated plate, which is connected to a bottom surface of the upper beam 101 of the window frame 100 through two pivot members 28, and a pivoting angle thereof can be appropriately adjusted. A length of the first movable plate 21 is proximately the same as the length of the headrail 12, and a portion of the first movable plate 21 extends downwardly to a rear side of the covering assembly 16 to slightly abut against the covering assembly 16. The first movable plate 21 naturally droops due to the gravity, with a bottom portion thereof abutting against the headrail 12. The first movable plate 21 is pushed and naturally pivoted by the covering assembly 16 rolled around the headrail 12. The first movable plate 21 covers the gaps S1 between the headrail 12 and the upper beam 101.

Figure 5:
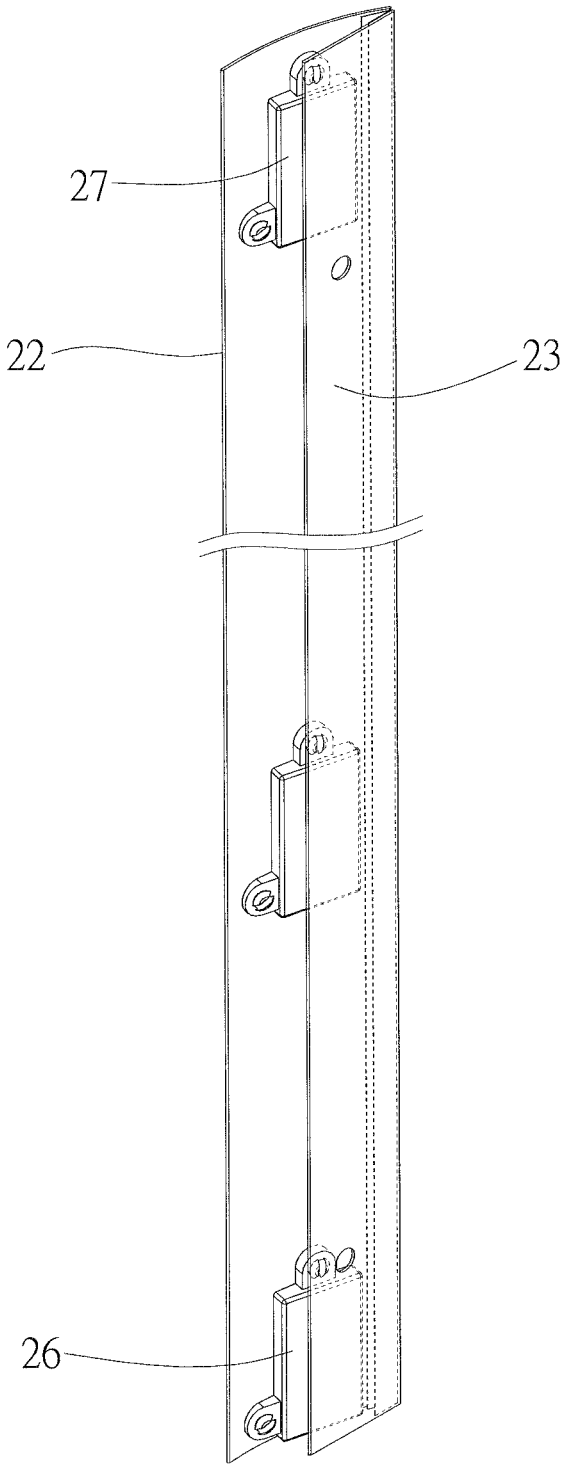
FIG. 5 is a perspective view of the first preferred embodiment, showing the structure of the auxiliary shading member.

The driving assembly includes two first magnetic member 25, two second magnetic members 26, and two third magnetic members 27. For the purpose of explanation, here we take one of the second movable plates 22, one of the fixing plates 23, one of the blocking plates 24, one of the first magnetic members 25, one of the second magnetic members 26, and one of the third magnetic members 27 as a set of components. As shown in FIG. 5, the second movable plate 22 and the fixing plate 23 are actually formed by bending one single plate, i.e., a long edge of the second movable plate 22 is integrated connected to a long edge of the fixing plate 23. As shown in FIG. 2, the fixing plate 23 is codirectionally fixed on a vertical lateral surface of one of the columns 102 of the window frame 100, with the opening of the bent plate facing the outside of the room. In the first preferred embodiment, the fixing plate 23 is fixed on the corresponding column 102 through a plurality of bolts 29 which pass through the fixing plate 23 and get locked in the corresponding column 102. Different means for achieving the same purpose, such as adhesion, are considered to be included in the present invention. Since the second movable plate 22 is connected to the fixing plate 23 with the long edge thereof, the second movable plate 22 can be pivoted relate to the fixing plate 23.

Figure 6:
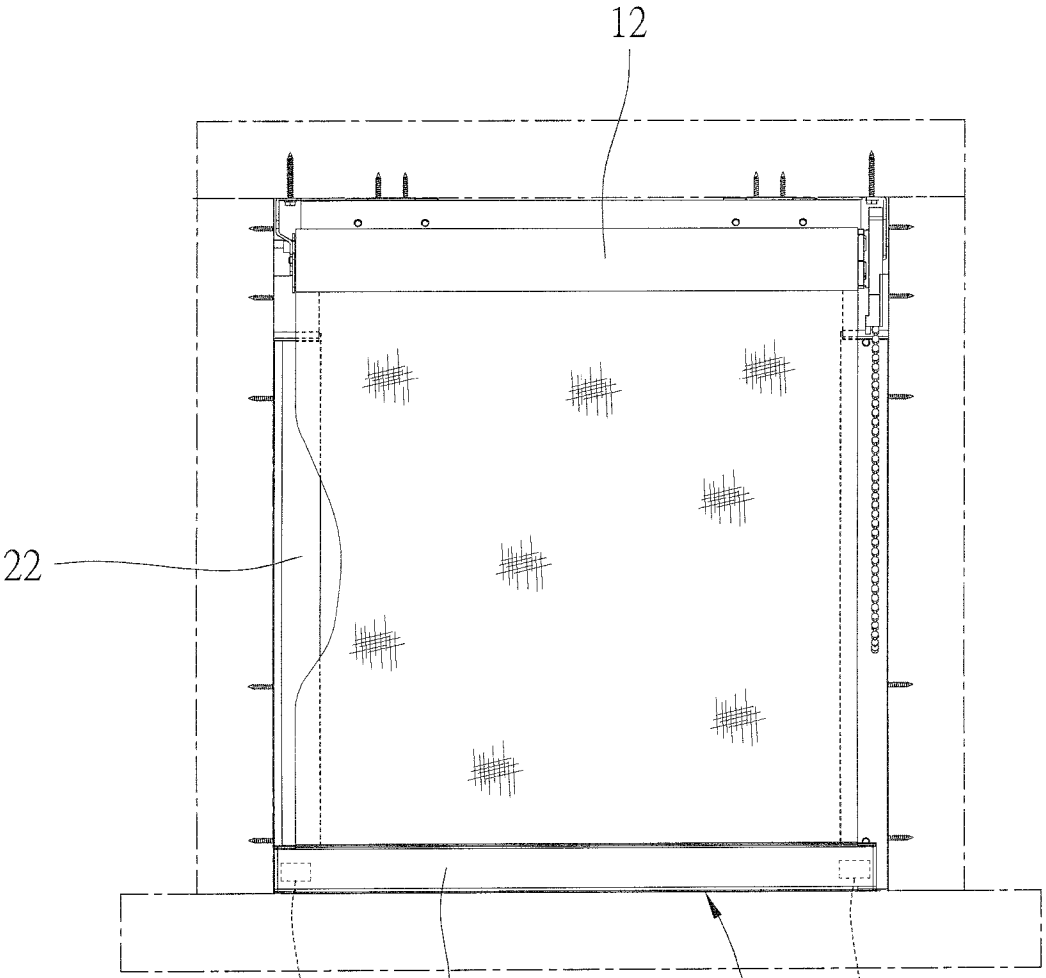
FIG. 6 is a front view, showing the covering assembly is fully extended.
Figure 7:
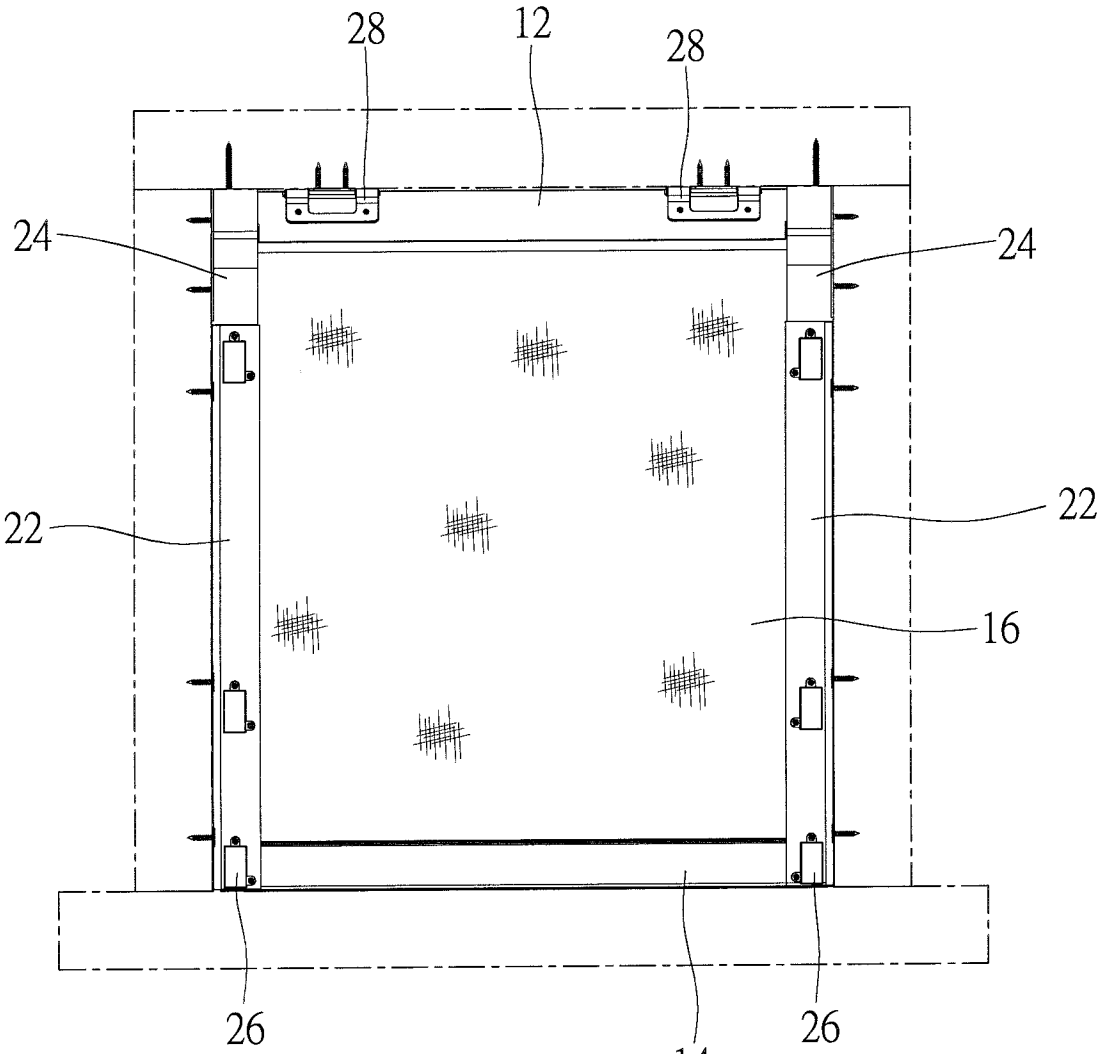
FIG. 7 is a back view of FIG. 6, further showing the second magnetic member is attracted by the first magnetic member.
Figure 8:
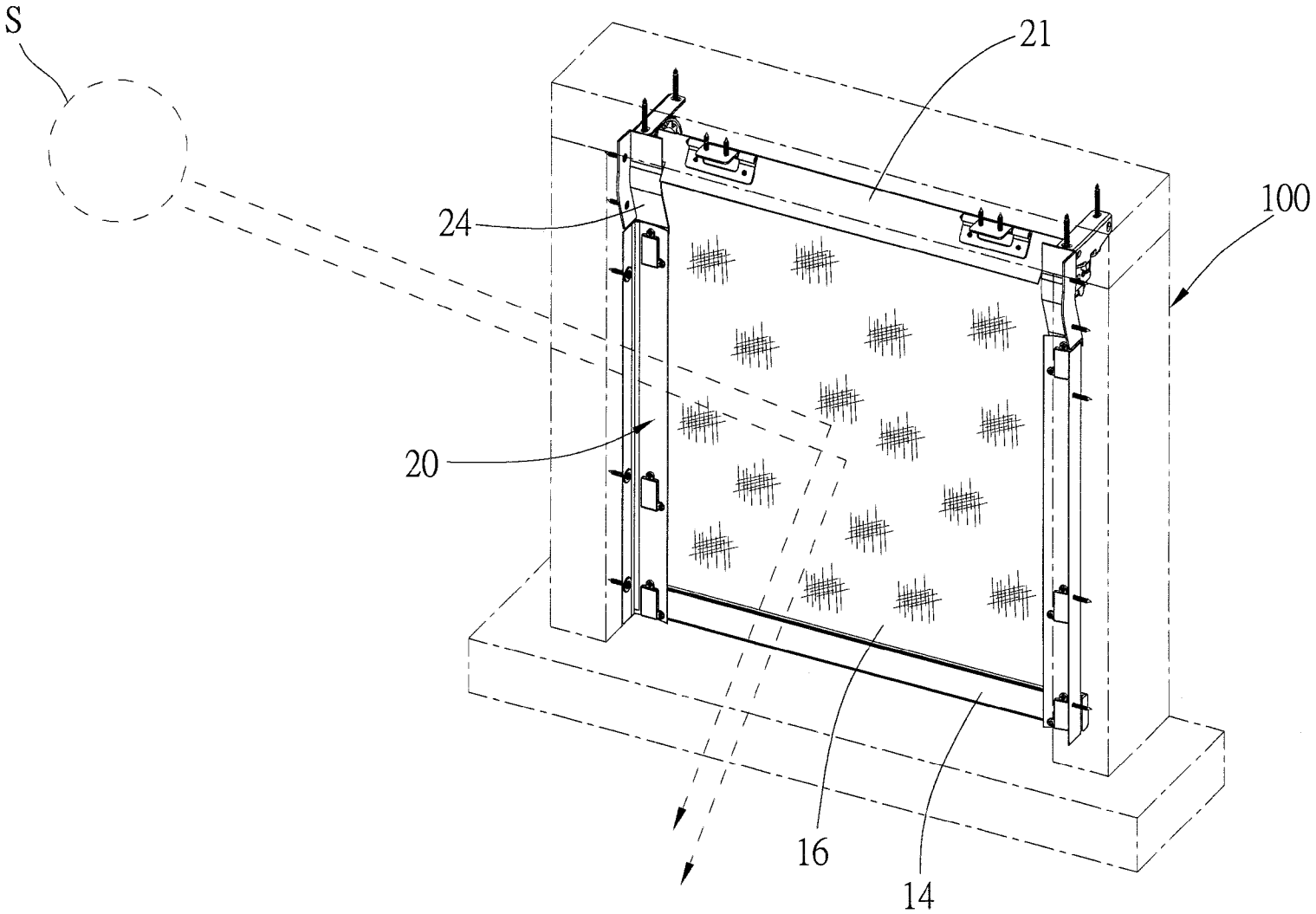
FIG. 8 is a perspective view, showing the relation between the external light and the first preferred embodiment.

In addition, the first magnetic member 25 is disposed at a side of the bottom rail 14, the second magnetic member 26 is fixedly disposed near a bottom end of the second movable plate 22, and the third magnetic member 27 is fixedly disposed near a top end of the second movable plate 22. It is worth mentioning that the second magnetic member 26 and the third magnetic member 27 are both magnets in the first preferred embodiment, wherein the second magnetic member 26 and the first magnetic member 25 are arranged with opposite poles facing each other, while the third magnetic member 27 and the first magnetic member 25 are arranged with the same pole facing each other. With such arrangement, when the bottom rail 14 is moved to a first position P1 which is away from the headrail 12, as shown in FIG. 6 to FIG. 8, the second magnetic member 26 is attracted by the first magnetic member 25, and therefore the second movable plate 22 is pivoted inwardly to contact a rear surface of the covering assembly 16. As a result, the gap S2 formed between one of the lateral sides of the covering assembly 16 and the corresponding column 102 of the window frame 100 can be covered. Similarly, the other gap S2 at the opposite side formed between the covering assembly 16 and the other column 102 of the window frame 100 is also covered by the second movable plate 22 of the other set of components. FIG. 8 shows the relation between an external light source S and the sunshade structure in the first preferred embodiment.

Figure 9:
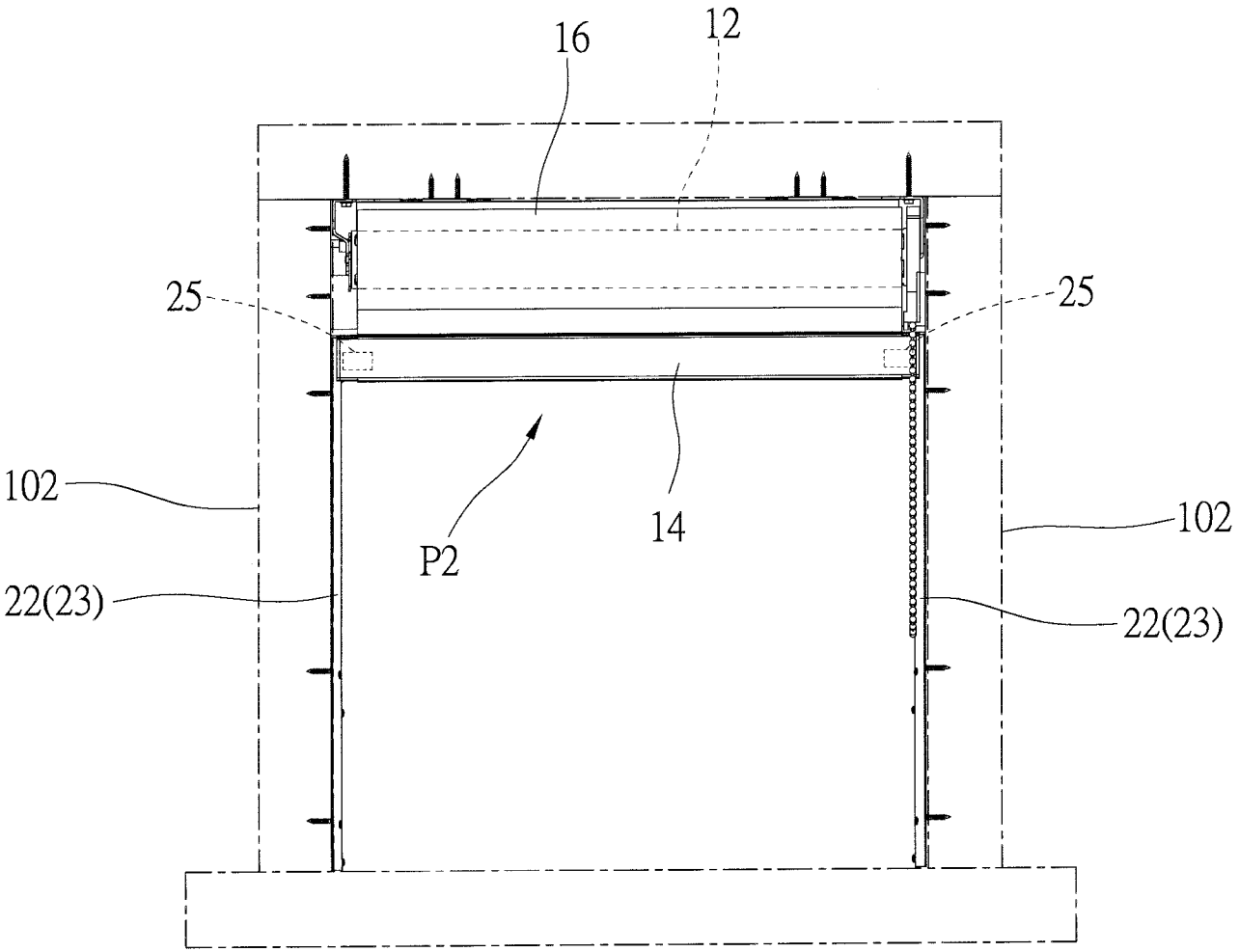
FIG. 9 is a front view similar to FIG. 6, showing the covering assembly is fully retracted.
Figure 10:
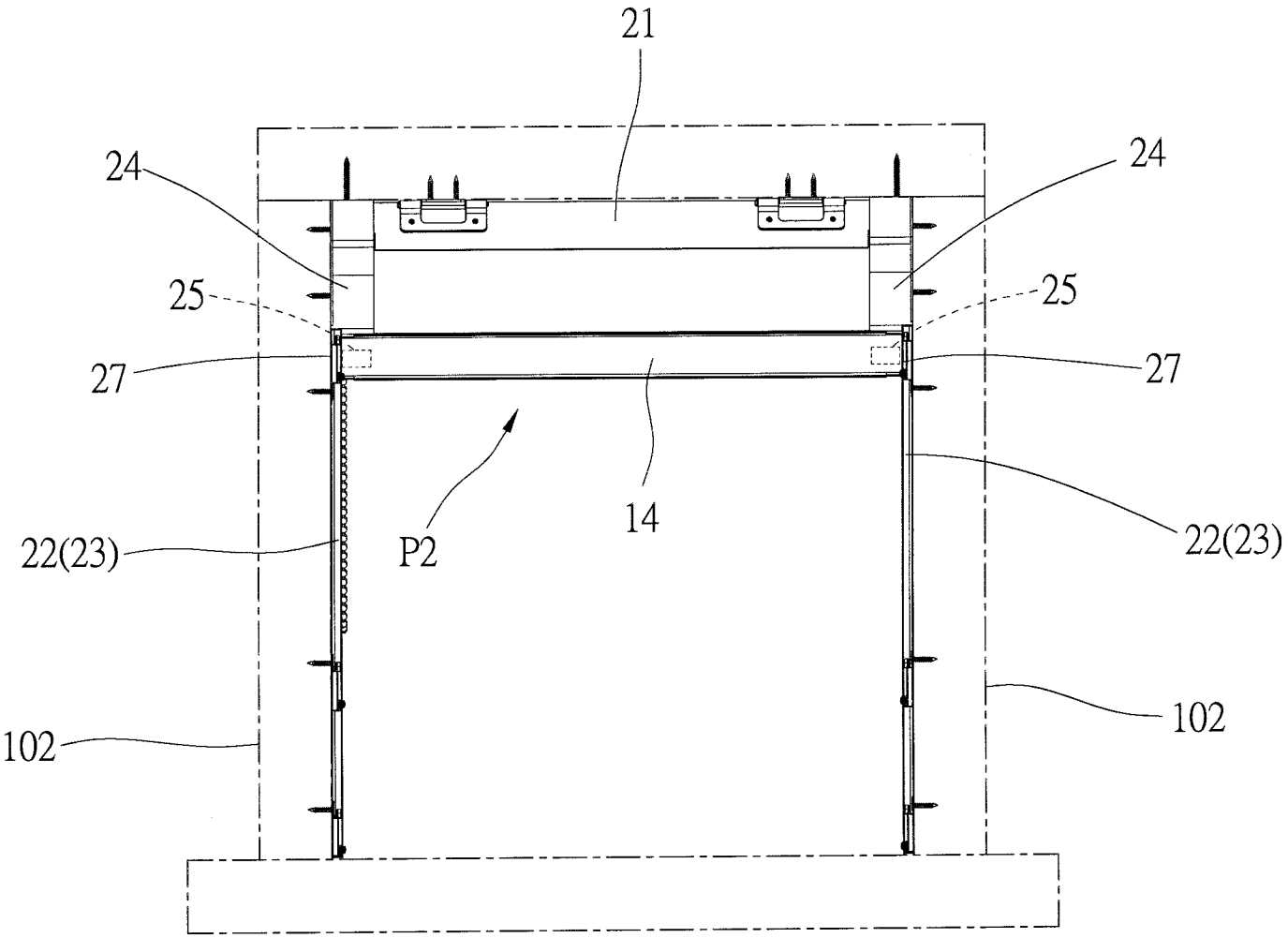
FIG. 10 is a back view similar to FIG. 7, further showing the third magnetic member is repelled outwardly by the first magnetic member.

On the contrary, when the bottom rail 14 is moved to leave the first position P1 and toward a second position P2 near the headrail 12 as illustrated in FIG. 9 and FIG. 10, the third magnetic members 27 are pushed outwardly, for each of the first magnetic members 25 is repelled by the corresponding third magnetic member 27 while passing by. Therefore, each of the second movable plates 22 is pivoted to contact the corresponding fixing plate 23 and, of course, to leave the covering assembly 16, so that the second movable plates 22 and the fixing plates 23 are respectively folded together on the columns 102 at both sides. As a result, light from outside can get into the room without being blocked out by the second movable plates 22.

In other preferred embodiments, the aforementioned first movable plate 21 and the second movable plates 22 could be omitted to meet different requirements. For example, if the gap S1 between the headrail 12 and the upper beam 101 is so small that it is actually not necessary to be covered, or there is already other object to cover the gap S1, the first movable plate 21 surely can be omitted, with only the second movable plates 22 to be installed.

Figure 11:
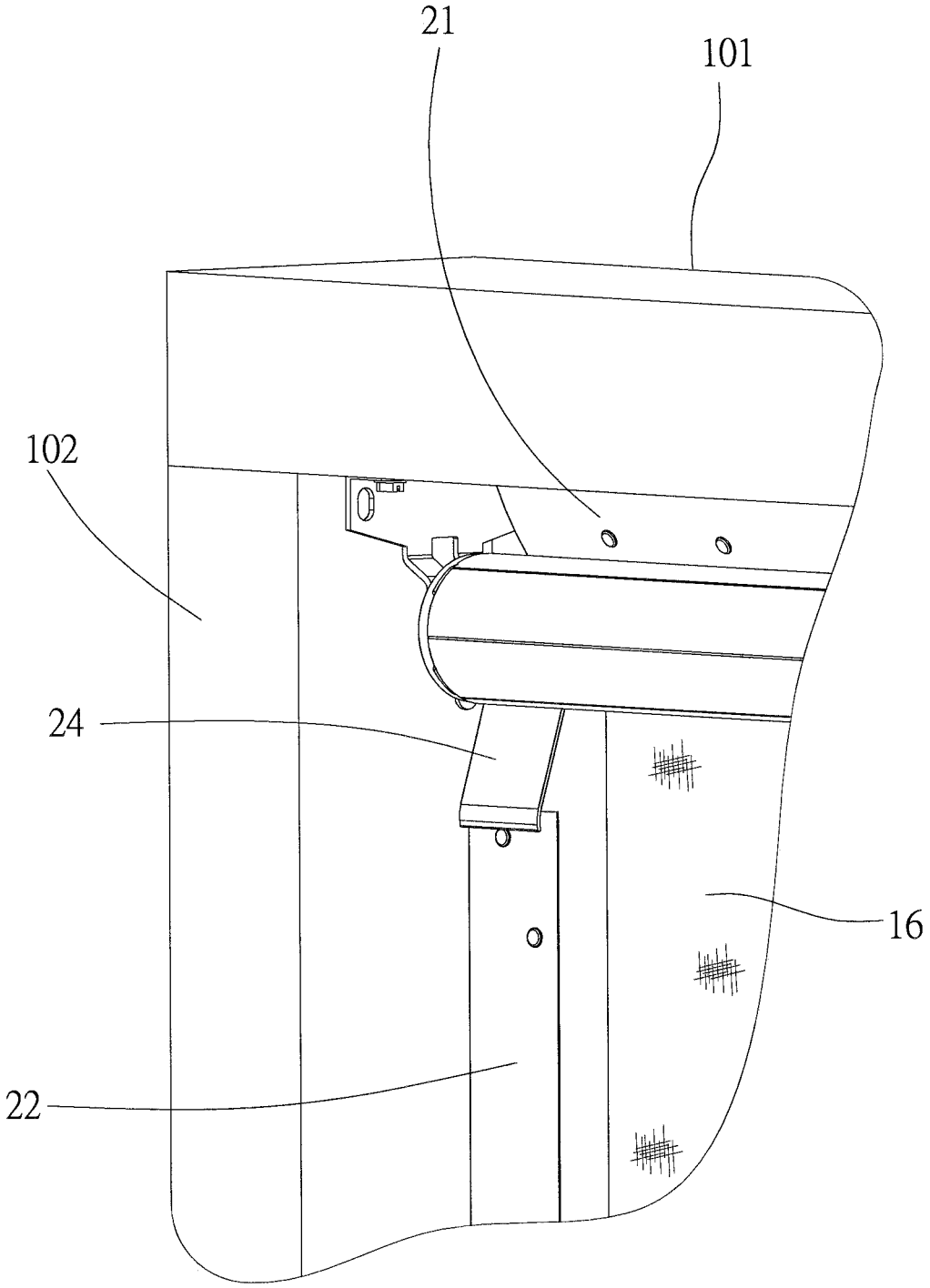
FIG. 11 is a perspective view, showing a part of the blocking plate of the auxiliary shading member extends downwardly and forwardly.

Again, here we take the set of components mentioned above for explanation. The blocking plate 24 is fixed at where the upper beam 101 of the window frame 100 and the corresponding column 102 are connected, wherein the blocking plate 24 covers potential gaps which may be formed between the headrail 12, the upper beam 101, the column 102, and the outwardly folded second movable plate 22 to ensure excellent light-blocking effect. It is worth mentioning that a part of the blocking plate 24 extends downwardly and forwardly, as shown in FIG. 11. When the second movable plate 22 is folded outwardly, this part of the blocking plate 24 is located between the second movable plate 22 and the covering assembly 16, i.e., a front side of the top end of the second movable plate 22. Such design also ensures excellent light-blocking effect.

In short, perfect sunshade effect can be achieved with the aforementioned design, for the gap S1 between the headrail 12 and the upper beam 101 is covered by the first movable plate 21, and the gaps S2 between the covering assembly 16 and the columns 102 of the window frame 100 are covered by the second movable plates 22. At the same time, by utilizing the physical effect of attraction or repulsion between each of the magnetic members, the second movable plates 22 can be automatically pivoted inwardly or outwardly without the need of manual operation.

It should be clarified that, if necessary, there can be one or more magnetic members other than the aforementioned second magnetic members 26 and third magnetic members 27 fixed on the second movable plates 22. By arranging the attraction/repulsion relation between each of these magnetic members and the first magnetic member 25, the second movable plate 22 can be gradually pivoted, whether inwardly or outwardly, along with the movement of the bottom rail 14.

In the aforementioned first preferred embodiment, the second movable plate 22 is controlled to pivot inwardly or outwardly through the forces of magnetic attraction and repulsion. However, in a second preferred embodiment, the driving assembly of the auxiliary shading member can also include a light sensor 30 and an electric motor 32 at each side as shown in FIG. 12 to FIG. 15, wherein the light sensor 30 is disposed at a bottom end of one of the columns 102 of the window frame 100, i.e., near the first position P1. The electric motor 32 is a micro electrical device coupled with the light sensor 30, wherein the electric motor 32 is fixed on the window frame 100 and under the upper beam 101. The electric motor 32 is controllable to swing a lever 34, wherein the lever 34 has an end extending into an elongated guide groove 36*a* of a guide block 36, which is fixedly connected to a side of the corresponding second movable plate 22.

Figure 12:
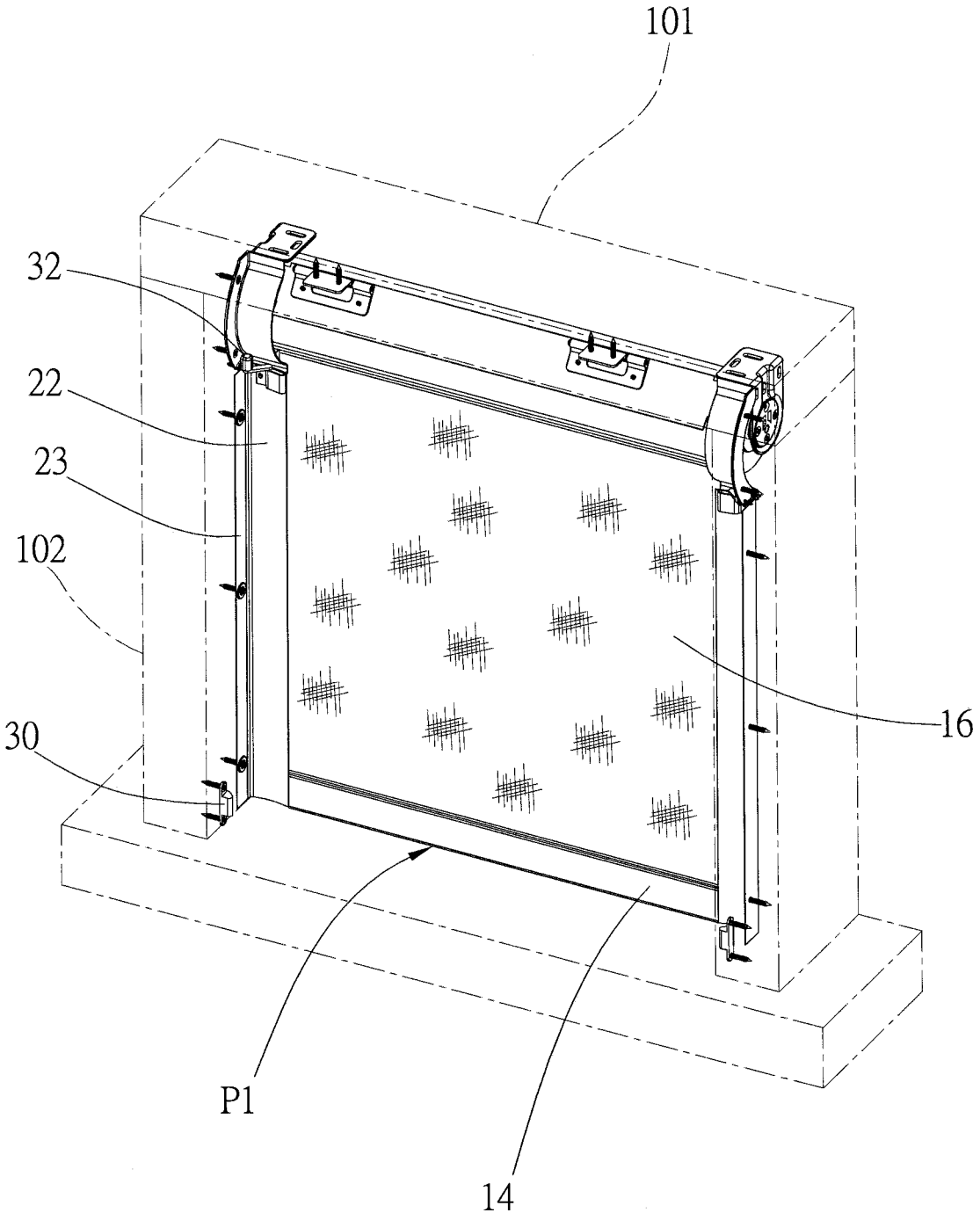
FIG. 12 is a perspective view of a second preferred embodiment, showing the covering assembly is fully extended.
Figure 13:
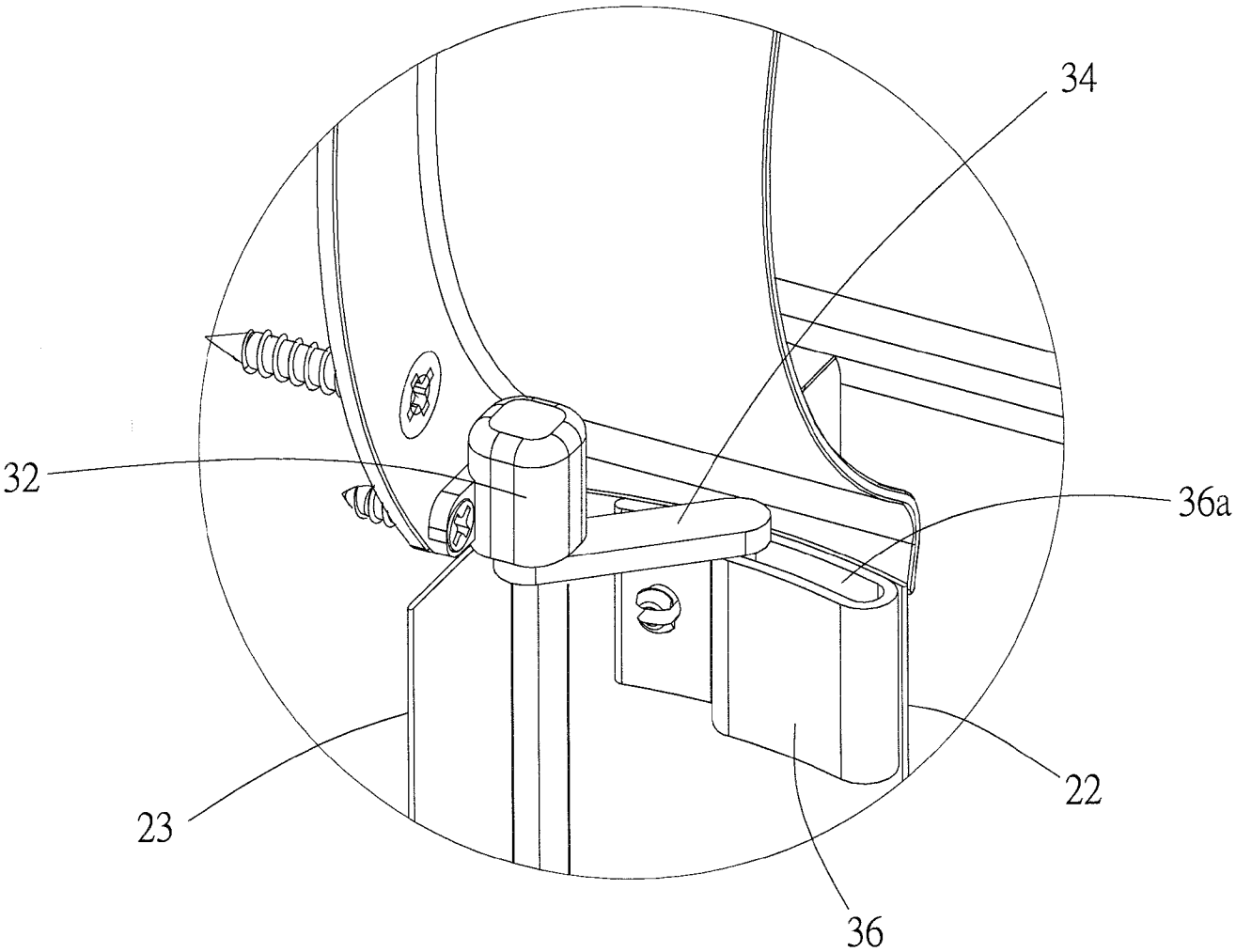
FIG. 13 is a partial enlarged view of FIG. 12.
Figure 14:
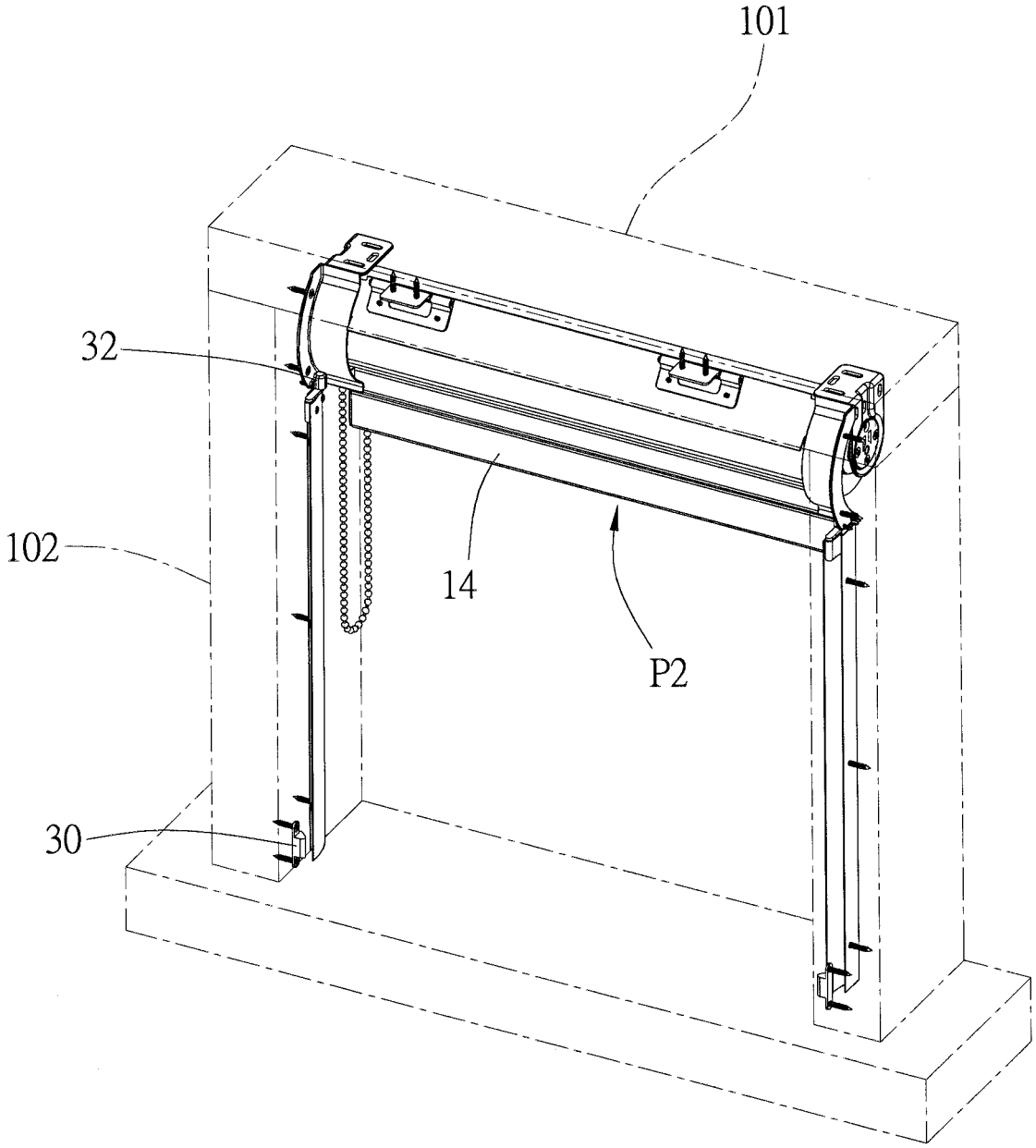
FIG. 14 is a perspective view of the second preferred embodiment, showing the covering assembly is fully retracted.
Figure 15:
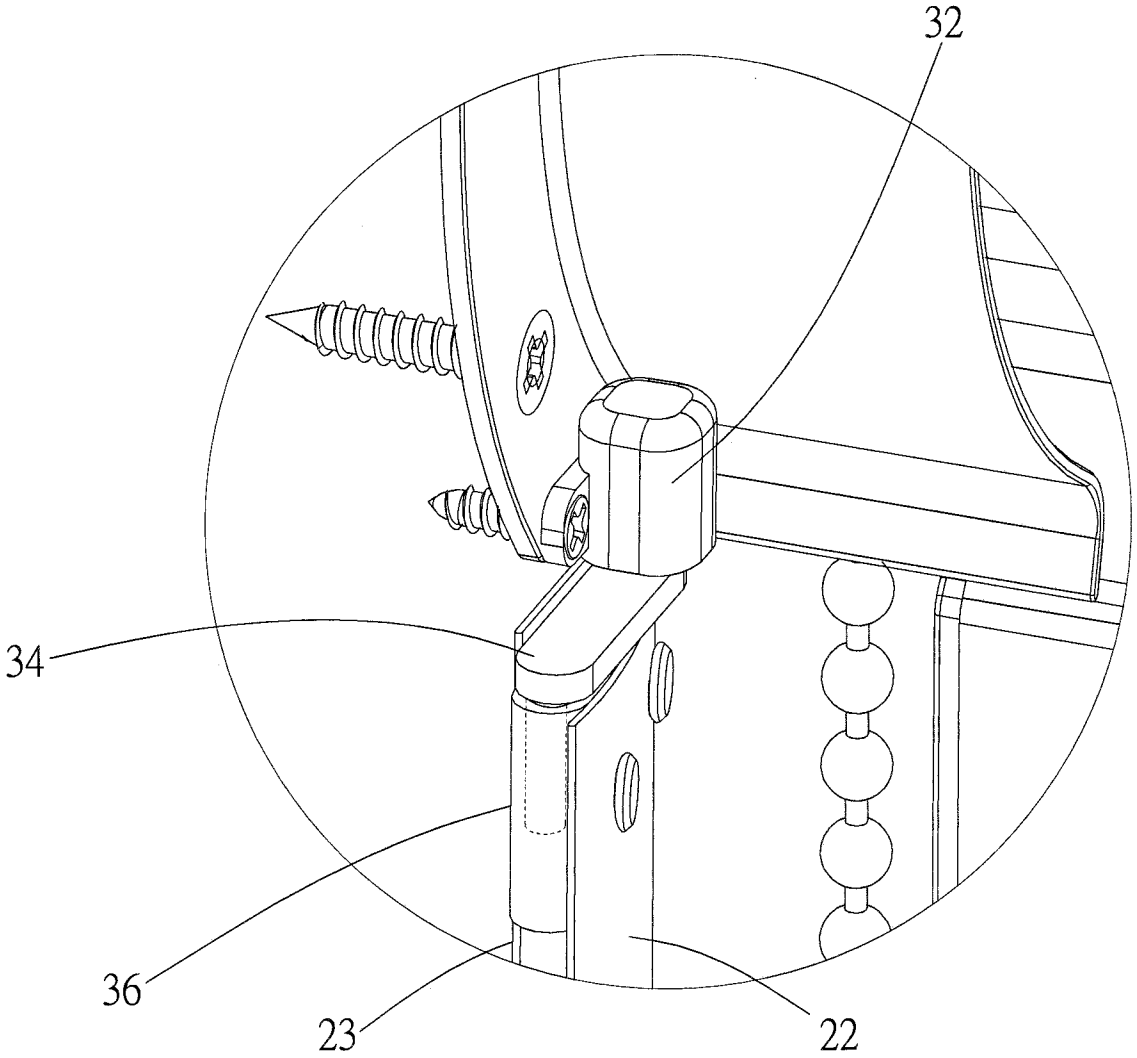
FIG. 15 is a partial enlarged view of FIG. 14.

As shown in FIG. 12 and FIG. 13, when the bottom rail 14 passes by the light sensor 30 and stays at the first position P1, the electric motor 32 drives the lever 34 to pivot the corresponding second movable plate 22 through the guide block 36, wherein the corresponding second movable plate 22 is pivoted inwardly to contact the rear surface of the covering assembly 16. In this way, the objective of covering the gaps S2 formed between the sides of the covering assembly 16 and the columns 102 can be also achieved. On the contrary, as shown in FIG. 14 and FIG. 15, when the bottom rail 14 is moved toward the second position P2 and passes by the light sensor 30, the electric motor 32 drives the lever 34 to swing in an opposite direction. Similarly, each of the second movable plates 22 is pivoted by the corresponding guide block 36 again to contact the corresponding fixing plate 23, and therefore the second movable plates 22 leave the covering assembly 16. As a result, light from outside can get into the room without being blocked out by the second movable plates 22.

In the aforementioned first preferred embodiment, the first movable plate 21 is connected to the upper beam 101 of the window frame 100 through the pivot members 28 to cover the gap S1 between the headrail 12 and the upper beam 101. However, in practice, the first movable plate 21 can also provide the same function without the pivot members 28. Here we provide several examples of implementation in the following paragraphs.

Figure 16:
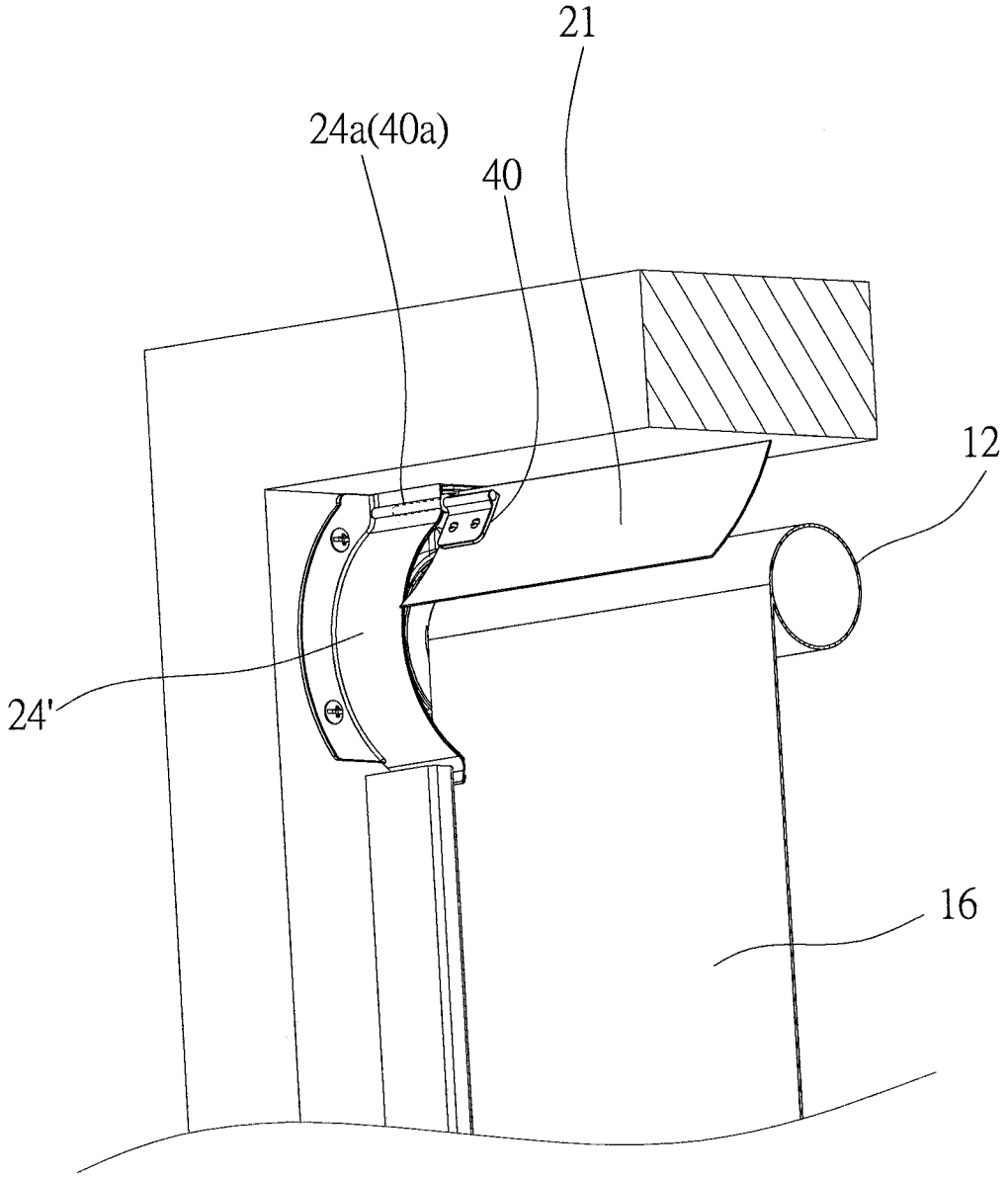
FIG. 16 and FIG. 17 are partial enlarged views, showing the first movable plate is pivotable with the shaft inserted into the blocking plate.
Figure 17:
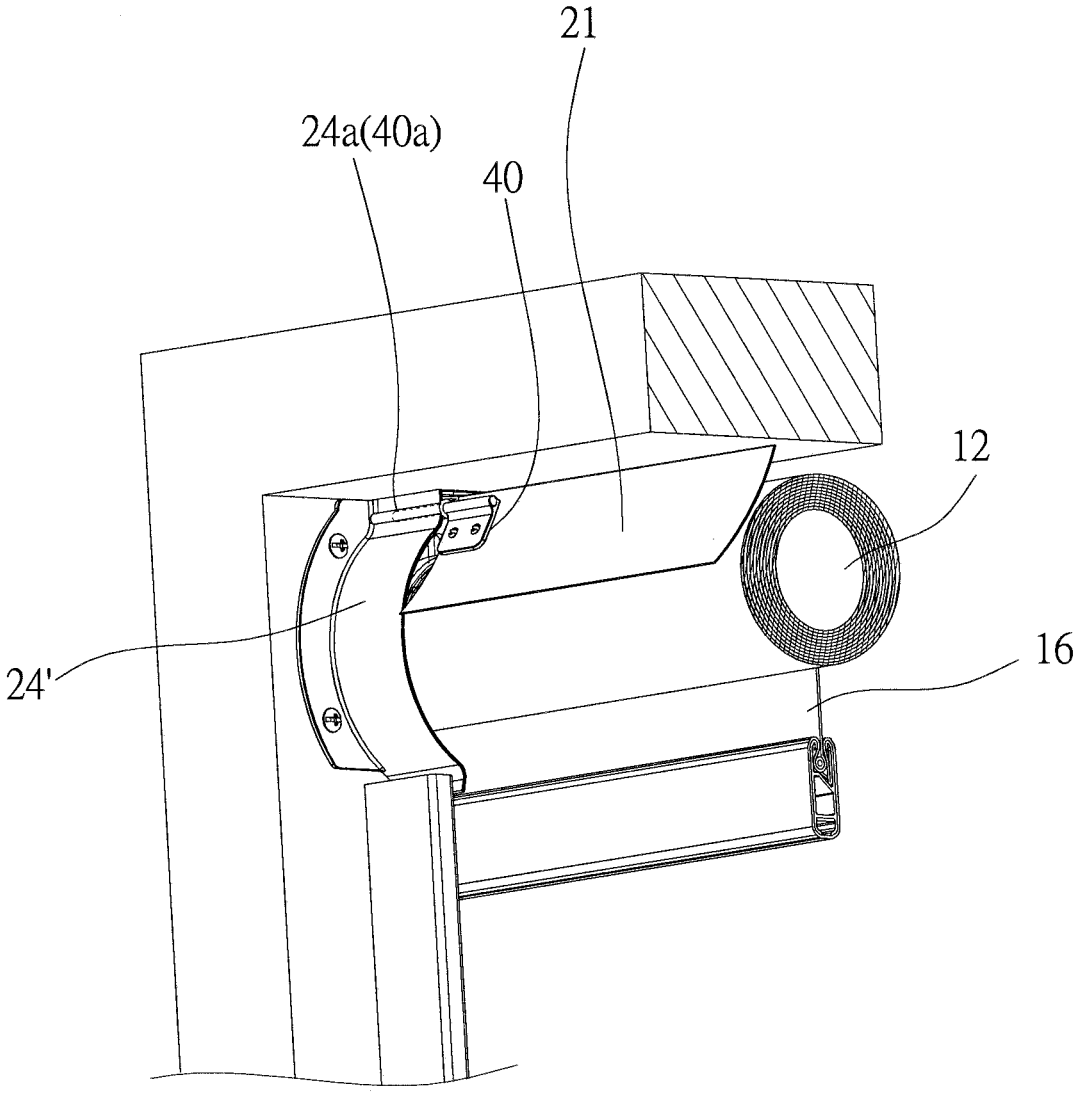

As shown in FIG. 16 and FIG. 17, each of the blocking plates 24' (only one of the blocking plate 24' is shown) has a pre-designed bore 24*a* provided on a top thereof, wherein the first movable plate 21 is pivotally connected to each of the blocking plates 24' through the fixing plate 40 which is fixed at a corner of a top edge thereof at the corresponding side. Each of the fixing plates 40 has a shaft 40*a* to be inserted into the corresponding bore 24*a*. Whereby, the first movable plate 21 is naturally pivoted by the covering assembly 16 rolled around headrail 12, and the light-blocking effect is not affected.

Figure 18:
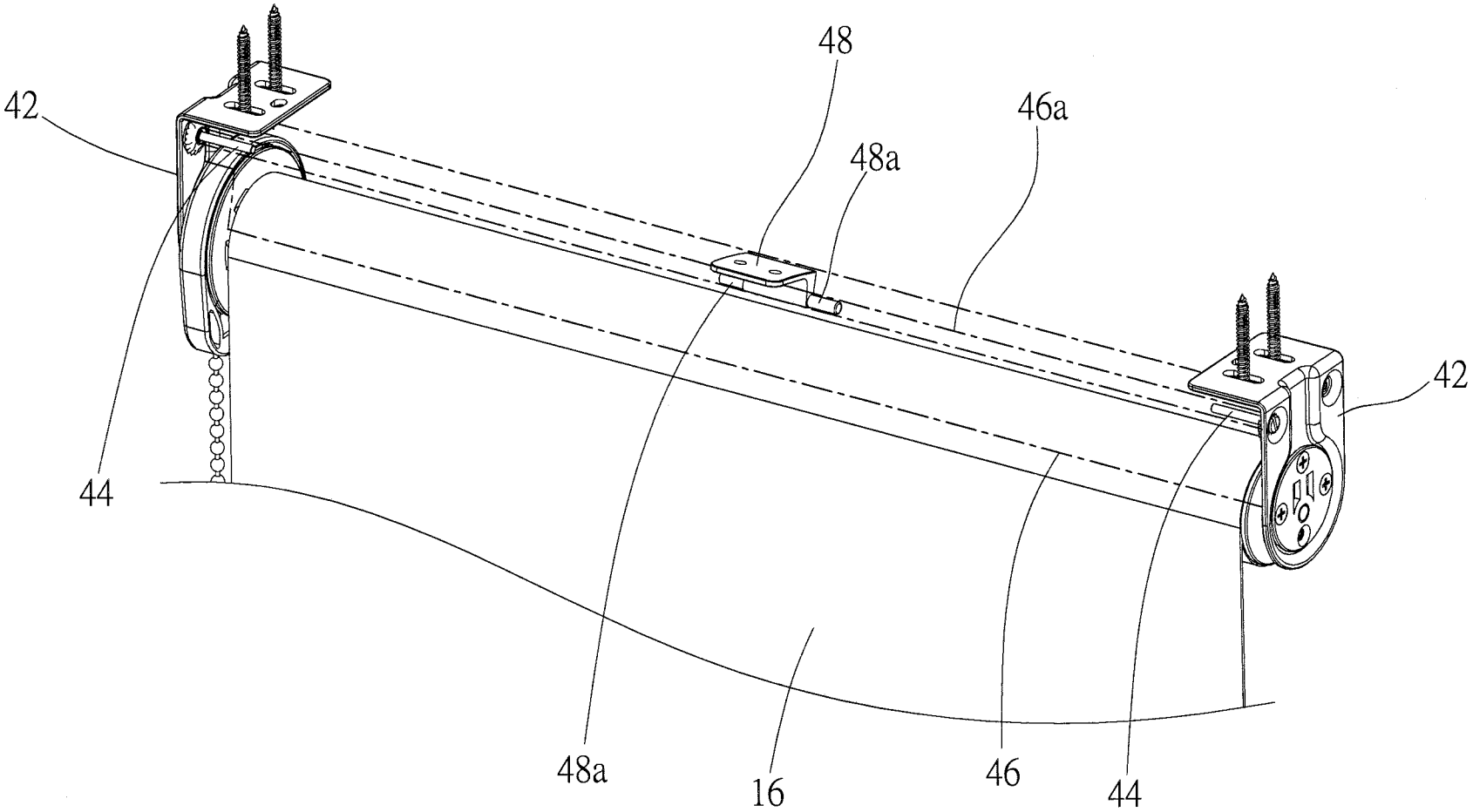
FIG. 18 is a partial enlarged view, showing the first movable plate is pivotable through the two pivot ears fixed on the columns of the window frame.

The auxiliary shading member shown in FIG. 18 does not have the aforementioned blocking plates, but has two pivot ears 42 and at least one pivot shaft 44 instead. Each of the two pivot ears 42 is respectively fixed on the upper beam 101 of the window frame 100, and contacts an inner surface (not shown) of one of the columns 102. The headrail 12 is provided between the two pivot ears 42 in a rotatable way. The number of the at least one pivot shaft 44 is two, and each of which is respectively fixed on one of the two pivot ears 42. In the current preferred embodiment, the first movable plate 46 (shown in doted lines) has a pre-designed rolled section on the top edge thereof, wherein the rolled section has a perforation 46*a*, which communicates with outside with both ends. An end of each of the two pivot shafts 44 is respectively inserted into the perforation 46*a* of the first movable plate 46 through one of the ends of the perforation 46*a*. In this way, the first movable plate 46 is provided at a top portion of the window frame 100 through the two pivot ears 42. Similarly, the first movable plate 21 can be naturally pivoted by the covering assembly 16 rolled around headrail 12 without affecting the light-blocking effect.

To prevent the first movable plate 46 from deforming at a middle portion thereof, the first movable plate 46 can be further provided with at least one notch at the rolled section to communicate with the perforation 46*a*. At the same time, at least one support member 48 is installed on the bottom surface of upper beam 101 of the window frame 100, wherein the at least one support member 48 has two corresponding extending ends 48*a*, which are respectively inserted into the perforation 46*a* through the notch to provide additional support.

In another embodiments, the at least one pivot shaft can be a thin and long single rod which directly goes through the perforation 46*a*, with two ends thereof fixed on the two pivot ears 42. In this way, the first movable plate 46 can be pivoted as described above. Similarly, in order to prevent the single rod from bending or deforming, there can be at least one notch provided at the rolled section of the first movable plate 46 to communicate with the perforation 46*a*, so that at least one part of the single rod is exposed to be hooked by at least one support member (not shown) installed on the upper beam 101, or alternatively, the single rod can also pass through a bore of the at least one support member.

Figure 19:
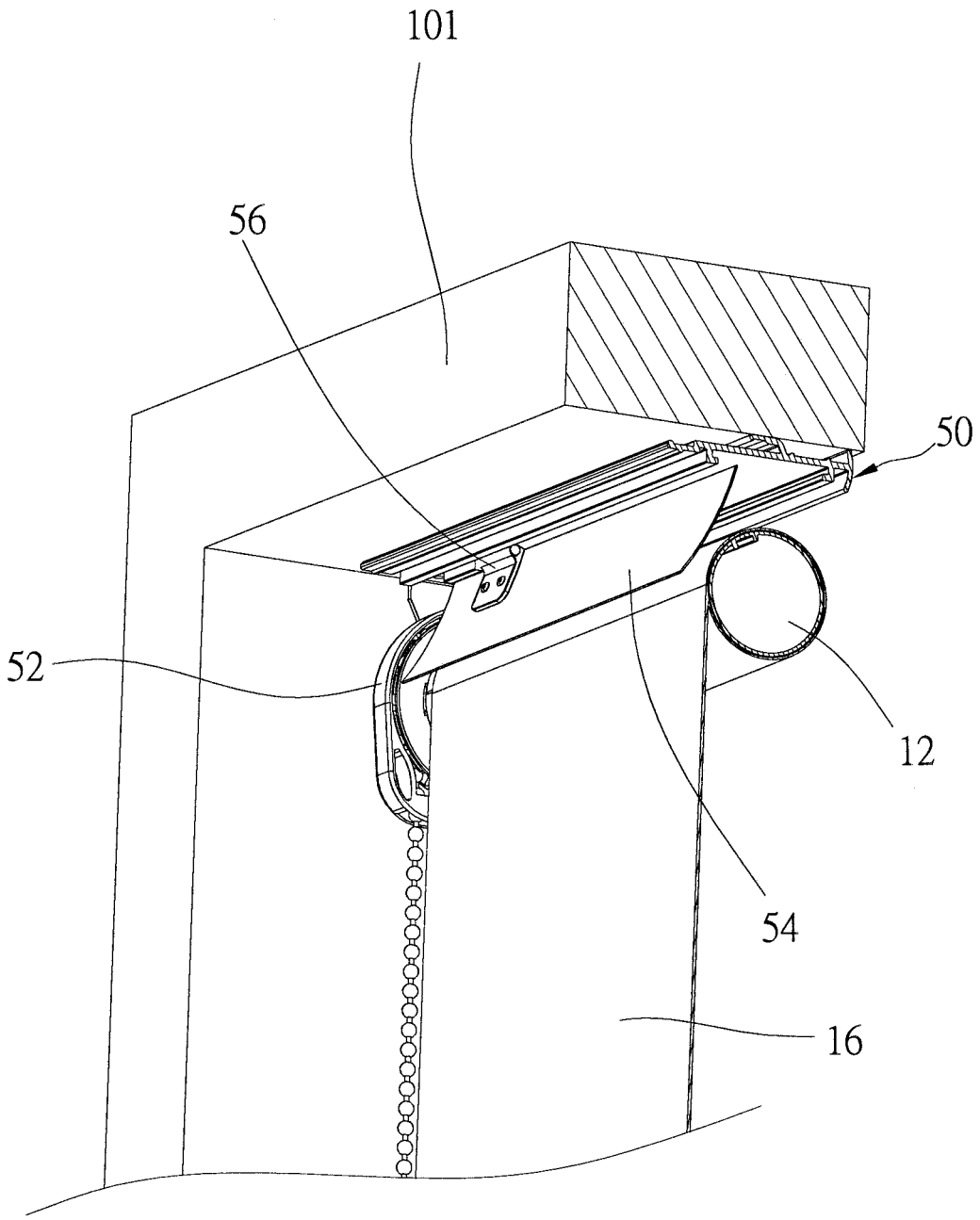
FIG. 19 is a partial enlarge view, showing the first movable plate is pivotable through the two pivot ears fixed on the frame.

The main shading member shown in FIG. 19 includes an extruded aluminum frame 50, wherein a side of the frame 50 is fixed to an inner surface of the upper beam 101 of the window frame 100, while each of two ends on another side thereof is respectively connected one of two pivot ears 52 (only one pivot ear 52 is shown). The headrail 12 is provided between the two pivot ears 52 in a rotatable way, and is provided at the top portion of the window frame 100 through the frame 50. In the current preferred embodiment, the first movable plate 54 is fixed to the frame 50 through two pivot plates 56, wherein the first movable plate 54 can be naturally pivoted by the covering assembly 16 rolled around the headrail 12.

It must be pointed out that the embodiments described above are only some preferred embodiments of the present invention. All equivalent structures which employ the concepts disclosed in this specification and the appended claims should fall within the scope of the present invention.

What is claimed is:

1. A sunshade structure, which is installed on a window frame of a building, comprising:

a main shading member, which comprises a headrail, a bottom rail, and a covering assembly connecting the headrail and the bottom rail, wherein the headrail is installed at a top portion of the window frame; the bottom rail is controllable to move between a first position, which is away from the headrail, and a second position, which is near the headrail;

an auxiliary shading member, which is fixed on the window frame, wherein the auxiliary shading member comprises at least one movable plate and a driving assembly, wherein the driving assembly includes components adjacent the first and second positions, and is adapted to drive the at least one moveable plate to pivot toward and away from the covering assembly, the pivoting of the at least one movable plate is caused by movement of the bottom rail toward the first and second positions; when the bottom rail is at the first position, the at least one movable plate is driven to approach the covering assembly to cover a gap formed between the covering assembly and one of two lateral columns of the window frame; and when the bottom rail is at the second position, the at least one moveable plate is away from the covering assembly.

2. The sunshade structure of claim 1, wherein the driving assembly comprises a first magnetic member, a second magnetic member, and a third magnetic member; the first magnetic member is disposed at a side of the bottom rail; the second magnetic member and the third magnetic member are disposed on one of the at least one movable plate; the second magnetic member and the first magnetic member are arranged with opposite poles facing each other, while the third magnetic member and the first magnetic member are arranged with same poles facing each other; when the bottom rail is at the first position, the first magnetic member attracts the second magnetic member to make the relevant movable plate approach the covering assembly to cover the gap formed between the covering assembly and one of the two columns of the window frame; when the bottom rail arrives at the second position, and passes by the third magnetic member, the first magnetic member repels the third magnetic member to pivot the relevant movable plate to leave the covering assembly.

3. The sunshade structure of claim 1, wherein the driving assembly comprises an electric motor and a light sensor; the electric motor is coupled with the light sensor to be driven by the light sensor; the electric motor is disposed at a side of one of the at least one movable plate; the light sensor is disposed on the window frame and near the first position; when the bottom rail passes by the light sensor and is located at the first position, the electric motor pivots the relevant movable plate to approach the covering assembly, and to cover the gap formed between the covering assembly and one of the two columns of the window frame; when the bottom rail is moved toward the second position and passes by the light sensor, the electric motor pivots the relevant movable plate to leave the covering assembly.

4. The sunshade structure of claim 2, wherein the auxiliary shading member comprises a blocking plate fixed on the top portion of the window frame; a part of the blocking plate extends downwardly to be in front of a top end of one of the at least one movable plate.

5. The sunshade structure of claim 3, wherein the auxiliary shading member comprises a blocking plate fixed on the top portion of the window frame; a part of the blocking plate extends downwardly to be in front of a top end of one of the at least one movable plate.

6. The sunshade structure of claim 1, further comprising a top movable plate disposed at the top portion of the window frame, and said top movable plate covers a gap formed between the headrail and an upper beam of the window frame.

7. The sunshade structure of claim 6, wherein the auxiliary shading member further comprises a blocking plate fixed at the top portion of the window frame; the blocking plate covers a gap formed between the headrail, the upper beam, and one of the two columns of the window frame; the top movable plate disposed at the top portion of the window frame is pivotally connected to the blocking plate, and a part of said top movable plate extends downwardly to a rear of the covering assembly.

8. The sunshade structure of claim 6, wherein the auxiliary shading member further comprises two pivot ears and at least one pivot shaft; each of the pivot ears is respectively fixed on one of the two columns of the window frame, wherein the headrail is provided there between; the at least one pivot shaft passes through a top edge of the top movable plate disposed at the top portion of the window frame, and two ends of the at least one pivot shaft are fixed to the pivot ears.

9. The sunshade structure of claim 1, wherein the main shading member further comprises a frame; a side of the frame is fixedly provided on an upper beam of the window frame, while another side of the frame is connected to the headrail; one of the at least one movable plate of the auxiliary shading member is fixed on the frame to cover a gap formed between the headrail and the upper beam of the window frame.

10. The sunshade structure of claim 1, wherein the auxiliary shading member comprises a fixing plate, which is fixed on a lateral surface of the window frame; a side of the fixing plate is connected to one of the at least one movable plate.

11. The sunshade structure of claim 10, wherein the fixing plate is codirectionally fixed on the lateral surface of the window frame; the fixing plate has a long edge, and the connected movable plate also has a long edge, wherein the fixing plate and the connected movable plate are connected to each other with their long edges, so that the connected movable plate is pivotable relative to the fixing plate.

12. A sunshade structure, which is installed on a window frame of a building, comprising:

a main shading member, which comprises a headrail, a bottom rail, and a covering assembly connecting the headrail and the bottom rail, wherein the headrail is installed at a top portion of the window frame; the bottom rail is controllable to move between a first position, which is away from the headrail, and a second position, which is near the headrail;

an auxiliary shading member, which is fixed on the window frame, wherein the auxiliary shading member comprises at least one movable plate and a driving assembly, wherein the driving assembly is adapted to drive the at least one moveable plate to pivot toward or away from the covering assembly, the pivoting of the at least one movable plate is caused by movement of the bottom rail toward the first and second positions; when the bottom rail is at the first position, the at least one movable plate is driven to approach the covering assembly to cover a gap formed between the covering assembly and one of two lateral columns of the window frame; and when the bottom rail is at the second position, the at least one moveable plate is away from the covering assembly;

wherein the driving assembly comprises a first magnetic member, a second magnetic member, and a third magnetic member; the first magnetic member is disposed at a side of the bottom rail; the second magnetic member and the third magnetic member are disposed on one of the at least one movable plate; the second magnetic member and the first magnetic member are arranged with opposite poles facing each other, while the third magnetic member and the first magnetic member are arranged with same poles facing each other; when the bottom rail is at the first position, the first magnetic member attracts the second magnetic member to make the relevant movable plate approach the covering assembly to cover the gap formed between the covering assembly and one of the two columns of the window frame; when the bottom rail arrives at the second position, and passes by the third magnetic member, the first magnetic member repels the third magnetic member to pivot the relevant movable plate to leave the covering assembly.

13. The sunshade structure of claim 12, wherein the auxiliary shading member comprises a blocking plate fixed on the top portion of the window frame; a part of the blocking plate extends downwardly to be in front of a top end of one of the at least one movable plate.

* * * * *